US011091899B1

(12) United States Patent
Kenkel et al.

(10) Patent No.: US 11,091,899 B1
(45) Date of Patent: Aug. 17, 2021

(54) HYDRAULIC FLUID WARM-UP USING RIDE CONTROL CIRCUIT

(71) Applicant: Deere & Company, Moline, IL (US)

(72) Inventors: Aaron R. Kenkel, East Dubuque, IL (US); Grant R. Henn, Dubuque, IA (US); Scott R. Stahle, Dubuque, IA (US); Brian K. Kellogg, Bellevue, IA (US)

(73) Assignee: DEERE & COMPANY, Moline, IL (US)

( * ) Notice: Subject to any disclaimer, the term of this patent is extended or adjusted under 35 U.S.C. 154(b) by 0 days.

(21) Appl. No.: 16/947,843

(22) Filed: Aug. 19, 2020

(51) Int. Cl.

| | |
|---|---|
| ***E02F 9/22*** | (2006.01) |
| ***F15B 1/02*** | (2006.01) |
| ***F15B 21/0427*** | (2019.01) |
| ***F15B 21/00*** | (2006.01) |

(52) U.S. Cl.
CPC ..... *E02F 9/2207* (2013.01); *F15B 1/021* (2013.01); *F15B 21/008* (2013.01); *F15B 21/0427* (2019.01); *F15B 2211/212* (2013.01)

(58) Field of Classification Search
CPC ... E02F 9/2207; E02F 9/2267; F15B 21/0427; F15B 1/021; F15B 21/08; F15B 21/042; F15B 21/045; F15B 2211/212; F15B 2211/8616; F15B 2211/8606; F15B 2211/861
See application file for complete search history.

(56) References Cited

U.S. PATENT DOCUMENTS

| | | | | |
|---|---|---|---|---|
| 5,733,095 | A | 3/1998 | Palmer et al. | |
| 6,962,050 | B2 | 11/2005 | Hiraki et al. | |
| 2006/0179831 | A1 | 8/2006 | Anderson et al. | |
| 2017/0130739 | A1* | 5/2017 | Zhang | E02F 9/2296 |
| 2018/0180068 | A1* | 6/2018 | Fukuda | E02F 9/2217 |

* cited by examiner

*Primary Examiner* — Abiy Teka
*Assistant Examiner* — Daniel S Collins

(57) ABSTRACT

In accordance with an example embodiment, a hydraulic system may include a pump, reservoir, accumulator, hydraulic cylinder, ride control valve assembly, and controller. The ride control valve assembly may include a charging valve, discharging valve, and a head ride control valve. The controller may open the head ride control valve when a ride control feature has been activated, or open the charging valve if the ride control feature has not been activated and a hydraulic fluid warmup is to be performed.

20 Claims, 6 Drawing Sheets

HYDRAULIC FLUID WARM-UP USING RIDE CONTROL CIRCUIT

TECHNICAL FIELD

The present disclosure generally relates to a hydraulic system. An embodiment of the present disclosure relates to a hydraulic circuit useable for both ride control and hydraulic fluid warm-up features.

BACKGROUND

Certain machines include hydraulic systems, such as vehicles which may utilize the hydraulic systems to move various components and perform work. The hydraulic systems on such machines may operate more optimally when the hydraulic fluid is within a target temperature range, and may operate less optimally in temperatures below that range. While the operation of the hydraulic system to perform work may incidentally warm the hydraulic fluid in the system, a warm-up feature may be included to accelerate the warm-up process and allow the hydraulic system to operate more optimally with less delay for warmup.

Certain machines with hydraulic systems may encounter loads on the hydraulic system or external forces on the machine which cause oscillation of the machine or hydraulic system, such as a vehicle driving across a surface which experiences bouncing due to uneven surface conditions. The hydraulic systems on such machines may include a ride control feature which controls certain components of the hydraulic system, such as hydraulic cylinders hydraulically connected to accumulators, to selectively move in a manner that counteracts and dampens the oscillations experienced by the machine or hydraulic system.

SUMMARY

Various aspects of examples of the present disclosure are set out in the claims.

According to a first aspect of the present disclosure, a hydraulic system may include a pump, a reservoir, an accumulator, a hydraulic cylinder, a ride control valve assembly, and a controller. The ride control valve assembly may include a charging valve, including a charging valve inlet and a charging valve outlet, a discharging valve, and a head ride control valve. The charging valve inlet and charging valve outlet may be hydraulically connected when the charging valve is in an open position and hydraulically disconnected when the charging valve is in a closed position. The charging valve inlet may be hydraulically connected to the pump so as to receive hydraulic fluid from the pump. The charging valve outlet may be hydraulically connected to the accumulator. The discharging valve may include a discharging valve inlet and a discharging valve outlet, the discharging valve inlet and discharging valve outlet hydraulically connected when the discharging valve is in an open position and hydraulically disconnected when the discharging valve is in a closed position. The discharging valve inlet may be hydraulically connected to the charging valve outlet and the accumulator, with the discharging valve outlet hydraulically connected to the reservoir so as to provide hydraulic fluid to the reservoir. The head ride control valve may include a head ride control valve inlet and a head ride control valve outlet, the head ride control valve inlet and head ride control valve outlet hydraulically connected when the head ride control valve is in an open position and hydraulically disconnected when the head ride control valve is in a closed position. The head ride control valve inlet may be hydraulically connected to the hydraulic cylinder and the head ride control valve outlet may be hydraulically connected to the accumulator.

The controller may be in communication with the ride control valve assembly, and include a processor and a memory including instructions saved thereon, wherein the processor is configured to execute the instructions to: determine whether a ride control feature has been activated, move the head ride control valve to the open position in response to determining the ride control feature has been activated, determine whether to perform hydraulic fluid warmup, and move the charging valve to the open position in response to determining that the ride control feature has not been activated and that hydraulic fluid warmup is to be performed.

The above and other features will become apparent from the following description and accompanying drawings.

BRIEF DESCRIPTION OF THE DRAWINGS

The detailed description of the drawings refers to the accompanying figures.

DETAILED DESCRIPTION

Figure 1:
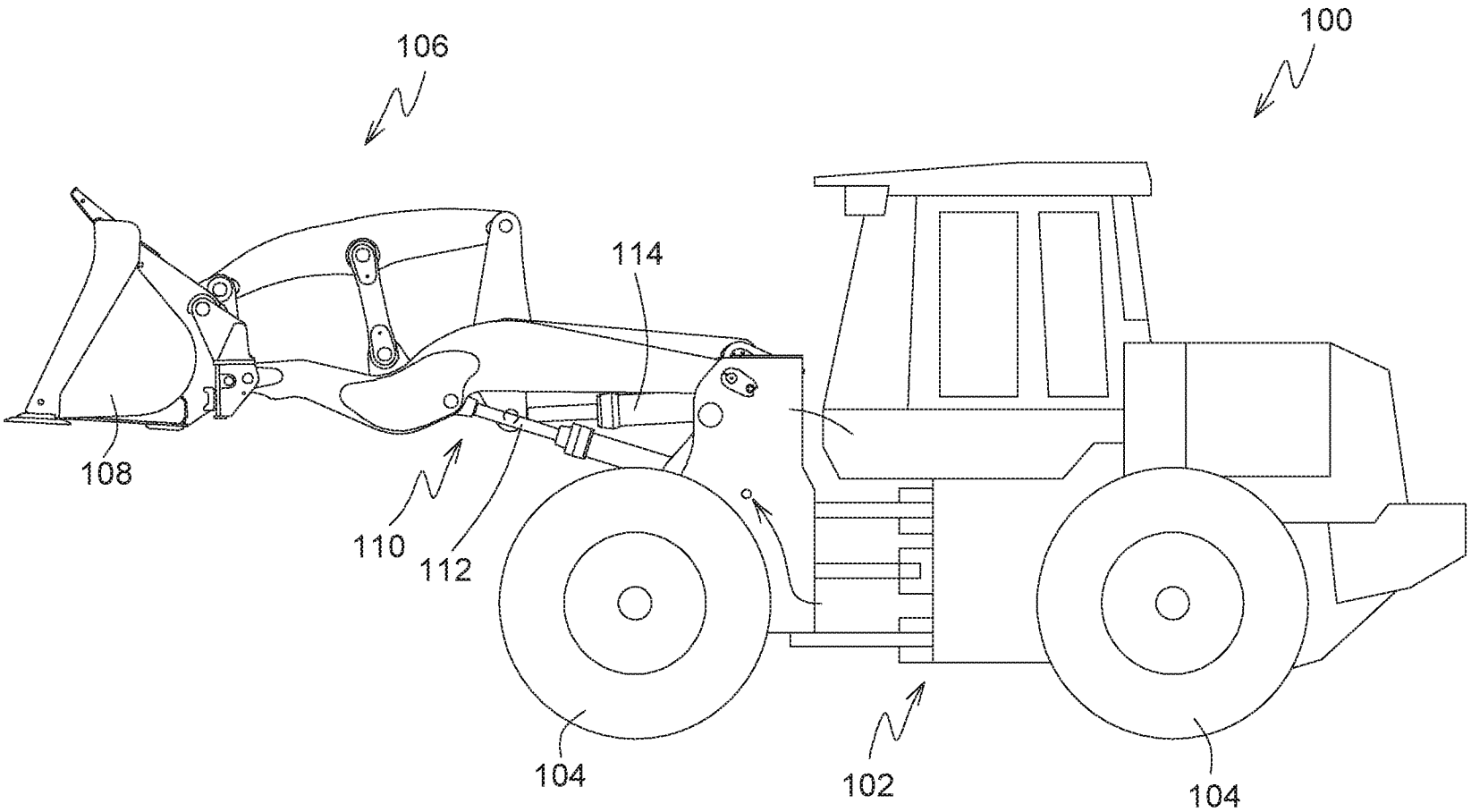
FIG. 1 is a left side view of a machine, in this embodiment a wheel loader work vehicle.

At least one example embodiment of the subject matter of this disclosure is understood by referring to FIGS. 1 through 6 of the drawings, in which like reference numerals are used to indicate like elements throughout the several figures.

FIG. 1 is a left side view of a work vehicle 100. The work vehicle 100 is illustrated as a wheel loader in this embodiment, but could also be any number of other work vehicles with a hydraulic system, such as a backhoe loader or skid steer, to name but two examples. The work vehicle 100 comprises a chassis 102 to provide structure and support to the components of the work vehicle 100. The work vehicle 100 travels along a ground surface via four wheels 104 in this embodiment, but other ground-engaging means such as tracks could be utilized in other embodiments. Additionally, the number of ground engaging means may vary from the example embodiment shown in the Figures and described herein. At a front end of the work vehicle 100 is a linkage 106, which consists of multiple rigid members pivotally connected to each other and connected to the chassis 102 at one end and a work tool 108, in this embodiment a bucket, at the opposite end. The linkage 106 is actuated by a hydraulic system 110, which may include but is not limited to, multiple hydraulic pumps, cylinders, valves, and plumbing, of which one of two boom cylinders 112 and a bucket cylinder 114 are visible in FIG. 1.

Figure 2:
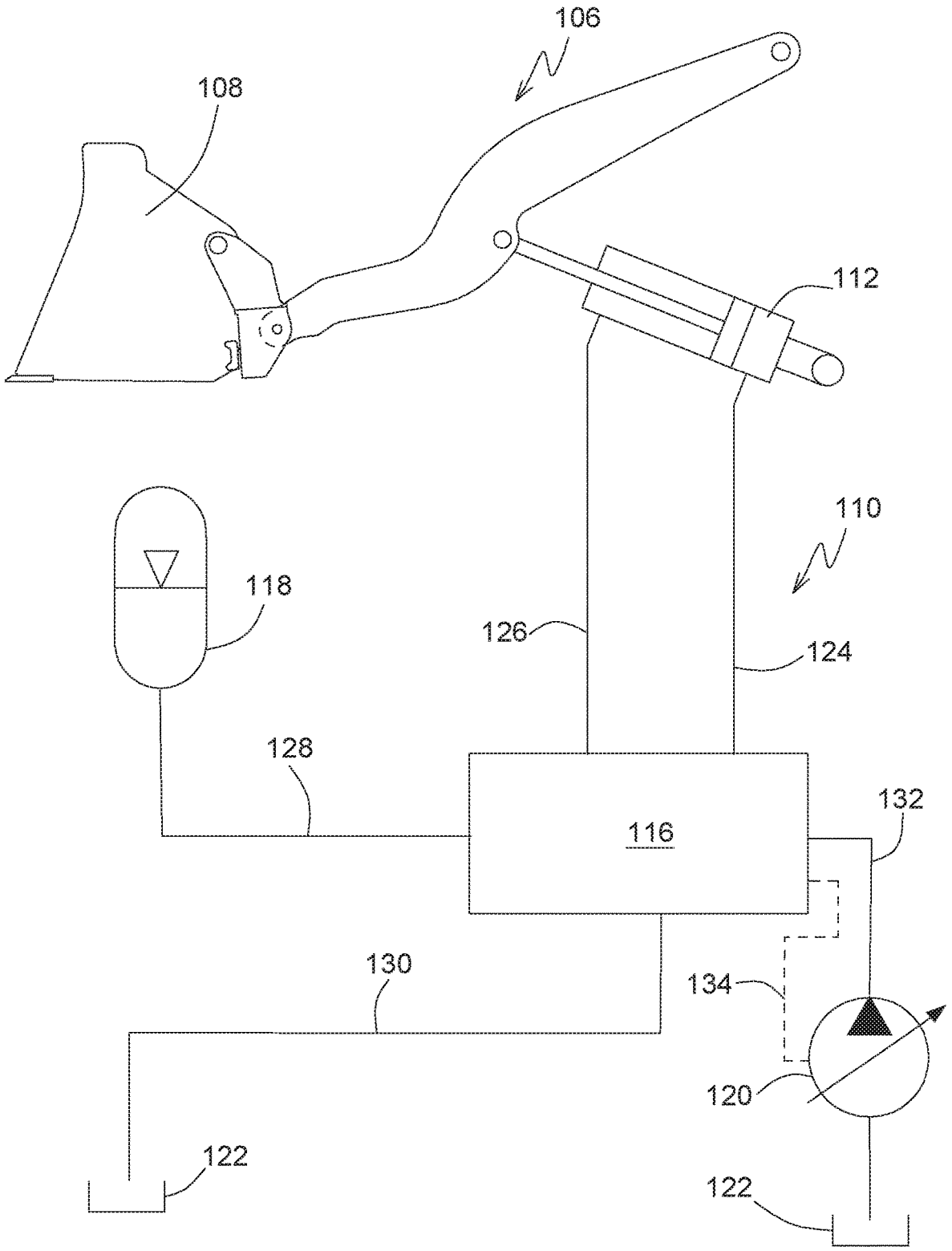
FIG. 2 is a schematic view of portions of a linkage and hydraulic system of the machine.

FIG. 2 is a schematic view of a portion of the linkage 106, a portion of the hydraulic system 110 including the boom cylinders 112 and other components, and the work tool 108. The hydraulic system 110 includes a valve block 116, which is hydraulically connected to the boom cylinders 112, allowing it to control the flow of hydraulic fluid to and from both the head and rod ends of the boom cylinders 112. The valve block 116 is also hydraulically connected to an accumulator 118, a hydraulic pump 120 (in this embodiment a variable displacement load-sensing pump), and a hydraulic reservoir 122. As shown in later figures, the valve block 116 permits a ride control feature where hydraulic fluid moves between the boom cylinders 112 and the accumulator 118, which permits the boom cylinders 112 to extend and retract in a limited fashion and move the linkage 106 and the work tool 108 relative to the chassis 102. This limited movement allows the mass of the work tool 108, the linkage 106, and the payload in the work tool 108 to float relative to the chassis 102 and thereby act as a dynamic counterweight, counteracting and thereby dampening oscillations of the work vehicle 100 which may be caused by uneven surface conditions over which the work vehicle 100 is traveling or other external forces acting on the work vehicle 100.

The valve block 116 includes multiple hydraulic ports through which it is hydraulically connected to other hydraulic components. The valve block 116 is hydraulically connected to the head end of the boom cylinders 112 via line 124 and to the rod end of the boom cylinders 112 via line 126. The valve block 116 is hydraulically connected to the accumulator 118 via line 128 and the reservoir 122 via line 130. The valve block 116 is hydraulically connected to the output or working port of the pump 120 via line 132, and to the load-sensing port of the pump 120 via line 134.

Figure 3:
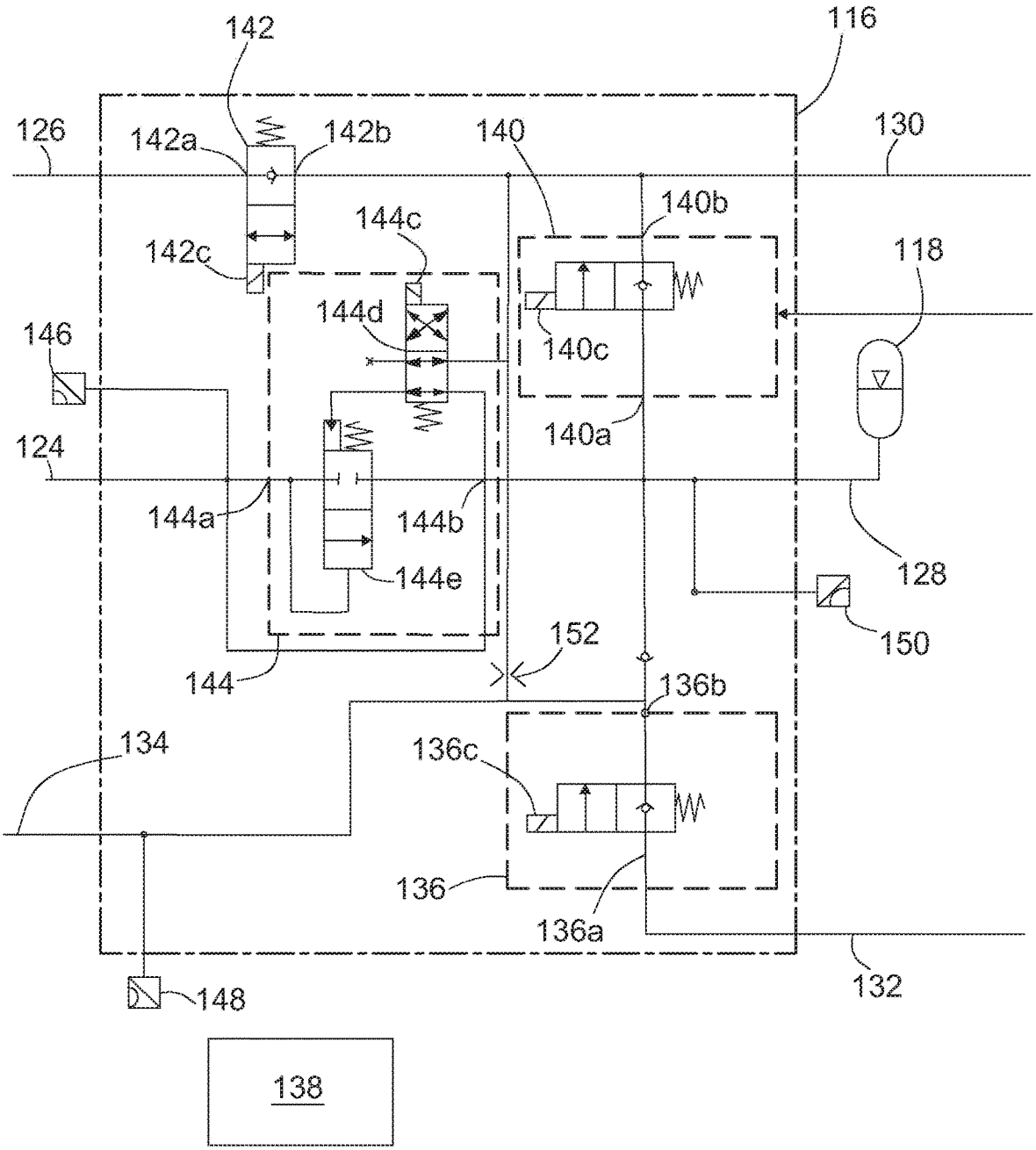
FIG. 3 is a hydraulic schematic of a portion of the hydraulic system of the machine, including a hydraulic circuit for ride control and warm-up features, in a first state.
Figure 4:
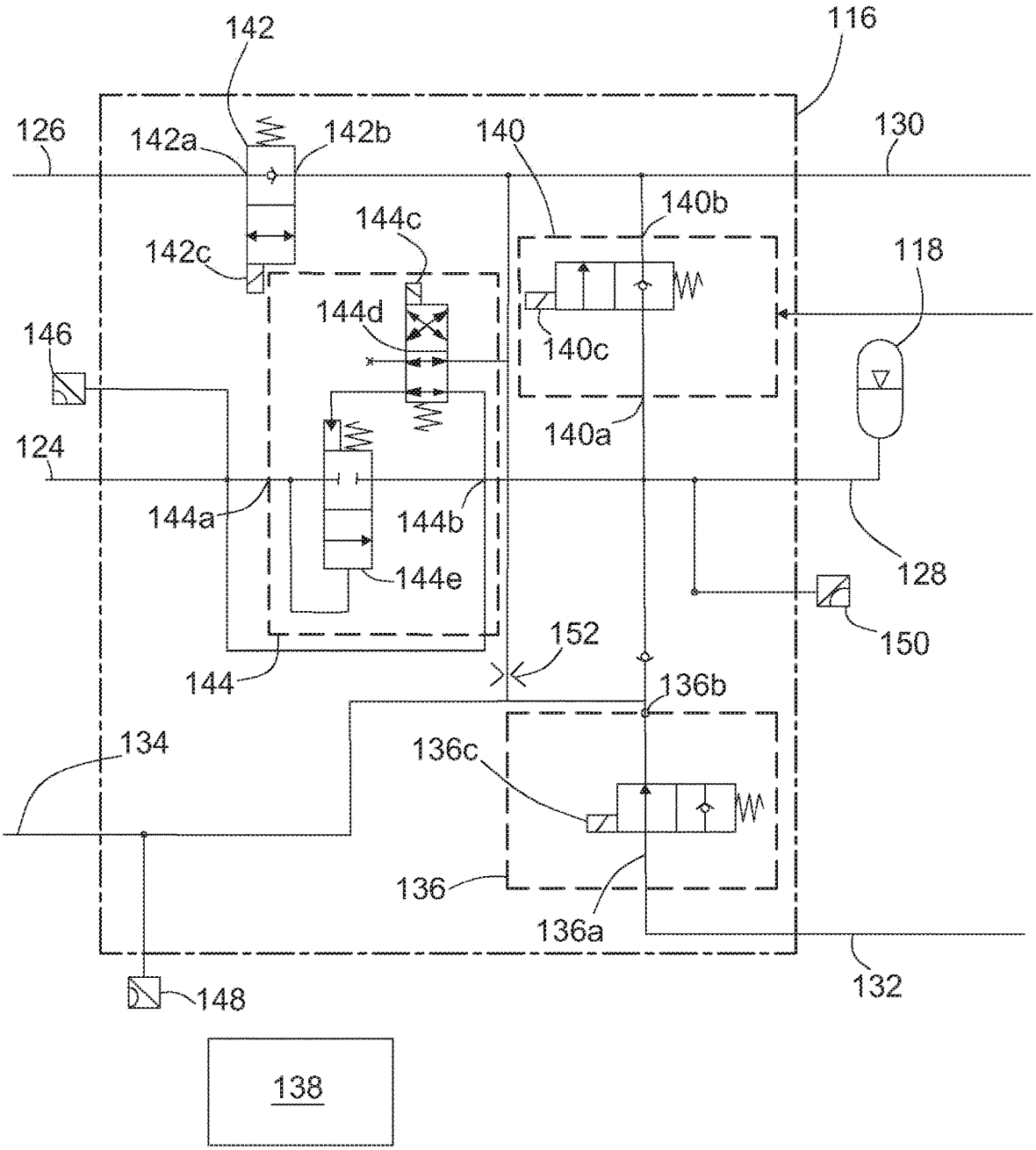
FIG. 4 is a hydraulic schematic of a portion of the hydraulic system of the machine, including a hydraulic circuit for ride control and warm-up features, in a second state.
Figure 5:
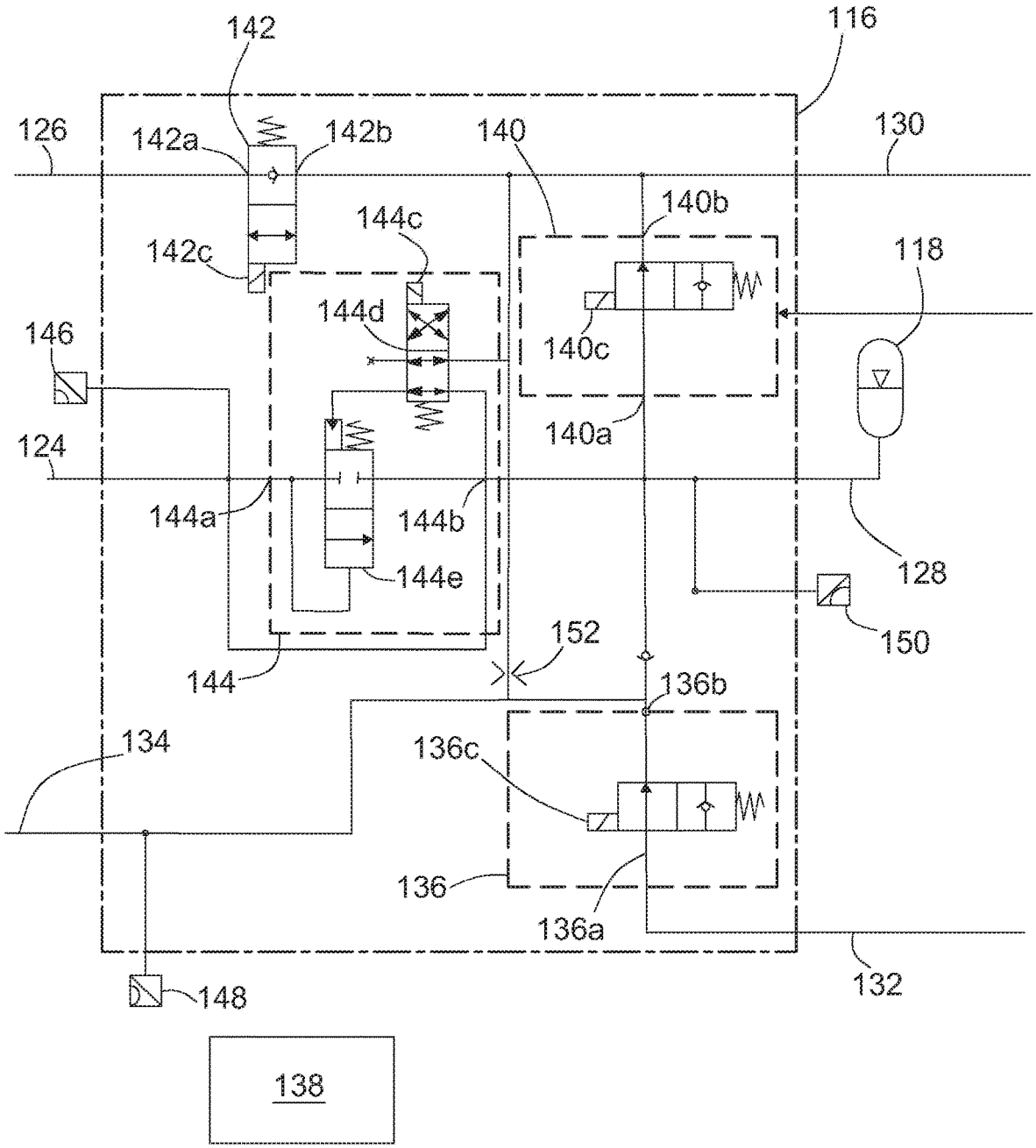
FIG. 5 is a hydraulic schematic of a portion of the hydraulic system of the machine, including a hydraulic circuit for ride control and warm-up features, in a third state.

FIG. 3 is a hydraulic schematic illustrating certain components within the valve block 116 and how the valve block 116 is plumbed to connect to other components in the hydraulic system 110. The valve block 116 receives pressurized hydraulic fluid from the pump 120, which draws hydraulic fluid from the reservoir 122 and provides it to the valve block 116 via the line 132. Within the valve block 116, this pressurized hydraulic fluid is received by a charging valve 136. The charging valve 136 includes an inlet 136*a* and an outlet 136*b* which are hydraulically disconnected when the charging valve 136 is in a closed position as shown in FIG. 3, but are hydraulically connected when the charging valve 136 is in an open position as shown in FIG. 4 and FIG. 5. The charging valve 136 can be actuated between closed and open positions by a solenoid 136*c*, which in turn can be actuated by the application of current from a controller 138 to which it is electrically connected. For readability, the electrical connections between the controller 138 and the solenoid 136*c*, and other solenoids, sensors, and electrical components are not shown in FIGS. 3-5.

The outlet 136*b* of the charging valve 136 is hydraulically connected to the line 128, and thereby to the accumulator 118. The state or position of the charging valve 136 thereby controls the charging of the accumulator 118, by allowing or disallowing the pump 120 to draw hydraulic fluid from the reservoir 122 and pump it into the accumulator 118. While the charging valve 136 controls the charging of the accumulator 118 by the pump 120, the accumulator 118 is hydraulically connected to multiple other components in the valve block 116, such that the net charging or discharging effect on the accumulator 118 is controlled by multiple components, pressures, and flows.

The accumulator 118 is hydraulically connected to both the outlet 136*b* of the charging valve 136 as well as an inlet 140*a* of a discharging valve 140 within the valve block 116. Stated differently, the outlet 136*b* of the charging valve 136 is hydraulically connected to both the inlet 140*a* of the discharging valve 140 and the accumulator 118. The discharging valve 140 includes the inlet 140*a* and an outlet 140*b* which are hydraulically disconnected when the discharging valve 140 is in a closed position, as shown in FIG. 3 and FIG. 4, but are hydraulically connected when the discharging valve 140 is in an open position as shown in FIG. 5. The discharging valve 140 can be actuated between closed and open positions by a solenoid 140*c*, which is actuated by the controller 138 to which it is electrically connected. The outlet 140*b* of the discharging valve 140 is hydraulically connected to line 130 and thereby to the reservoir 122.

The line 130, and thereby the reservoir 122, is also hydraulically connected to an outlet 142*b* of a rod ride control valve 142. The inlet 142*a* of the rod ride control valve 142 is hydraulically connected to the line 126, and thereby to the rod end of the boom cylinders 112. When the rod ride control valve 142 is in the closed position as shown in FIGS. 3-5, the inlet 142*a* and the outlet 142*b* are hydraulically disconnected, while the inlet 142*a* and the outlet 142*b* are hydraulically connected when the rod ride control valve 142 is in the open position. The rod ride control valve 142 can be actuated between closed and open positions by the solenoid 142*c*, which is actuated by the controller 138 to which it is electrically connected. When the ride control feature of the hydraulic system 110 is active, the solenoid 142*c* shifts the rod ride control valve 142 from the closed position to the open position, thereby allowing hydraulic fluid to flow between the rod side of the boom cylinders 112 and the reservoir 122. This flow of hydraulic fluid avoids trapping hydraulic fluid on the rod side of the boom cylinders 112, and thereby allows the boom cylinders 112 to extend or retract as needed for the ride control feature.

Also included in the valve block 116 is a head ride control valve 144. An inlet 144*a* of the head ride control valve 144 is hydraulically connected to the line 124 thereby hydraulically connecting it to the head side of the boom cylinders 112. An outlet 144*b* of the head ride control valve 144 is hydraulically connected to the line 128 (and thereby to the accumulator 118) as well as the outlet 136*b* of the charging valve 136 and the inlet 140*a* of the discharging valve 140. The inlet 144*a* and the outlet 144*b* are hydraulically disconnected when the head ride control valve 144 is in a closed position as shown in FIGS. 3-5, but are hydraulically connected when the head ride control valve 144 is in an open position. The head ride control valve 144 can be actuated between closed and open positions by a solenoid 144*c*, which is actuated by the controller 138 to which it is electrically connected. In more detail, actuation of the solenoid 144*c* shifts a first spool 144*d* thereby changing a first pilot pressure on a second spool 144*e* from being supplied by the line 124 (head side of the boom cylinders 112) to being supplied by the reservoir 122. The second spool 144*e* has the first pilot pressure acting to close it and on the opposite side has a second pilot pressure supplied by the line 124 acting to open it. Actuation of the solenoid 144*c* thereby permits the second spool 144*e* to move to an open position if the pressure in the head side of the boom cylinders 112 is sufficient. While this arrangement of the head ride control valve 144 is illustrated in FIGS. 3-5, alternative embodiments may utilize alternative arrangements to achieve the same operation.

The head ride control valve 144 functions to selectively allow hydraulic fluid to flow between the head side of the boom cylinders 112 and the accumulator 118, and thus selectively activates (along with the rod ride control valve 142) the ride control feature. When both the head ride control valve 144 and the rod ride control valve 142 are active (i.e., each respective solenoid 142*c* and 144*c* is actuated by the controller 138 to move the valves to open positions), and thus the ride control feature is active, hydraulic fluid can flow between the rod side of the boom cylinders 112 and the reservoir 122 and hydraulic fluid can flow between the head side of the boom cylinders 112 and the accumulator 118. These two fluid flows permit the boom cylinders 112 to extend and retract as needed to allow relative motion between the linkage 106 (and the connected work tool 108) and the chassis 102 of the work vehicle 100.

The hydraulic system 110 may also include multiple pressure sensors to monitor the hydraulic pressures at certain points in the hydraulic circuit. Such sensors can include a head side sensor 146 monitoring the hydraulic pressure on the head side of the boom cylinders 112, a load-sense sensor 148 monitoring the hydraulic pressure on the load-sense line 134, and an accumulator sensor 150 monitoring the hydraulic pressure of the accumulator 118. Each of these sensors is electrically connected to the controller 138 such that signals indicative of these pressures may be monitored by the controller 138. In alternative embodiments, some or all of these pressure sensors may instead be configured as combined pressure and temperature sensors that can indicate the hydraulic fluid pressure and temperature to the controller 138.

Also included within the valve block 116 is an orifice 152, which may also be referred to as a hydraulic orifice or flow restriction. The orifice 152 hydraulically connects the outlet 136*b* of the charging valve 136 to the reservoir 122, via the same hydraulic line 130 as the outlet 142*b* of the rod ride control valve 142 and the outlet 140*b* of the discharging valve 140. This orifice may be appropriately sized, for example at a diameter of 0.030 inches, to ensure that hydraulic fluid flow across it does not interfere with the function of the charging valve 136. In other embodiments, the orifice may have a different equivalent hydraulic diameter, for example in the range of 0.010 inches to 0.100 inches. Check valves may also be placed appropriately within the valve block 116 to ensure that the orifice 152 does not gradually drain fluid and pressure from the accumulator 118.

FIG. 4 is a hydraulic schematic illustrating the valve block 116 with the charging valve 136 in the open position and the discharging valve 140 in the closed position. In this configuration, the pump 120 provides pressurized hydraulic fluid to the valve block 116 via line 132. With the charging valve 136 in the open position, the hydraulic fluid received by the valve block 116 can cross the charging valve 136 where it can fill the accumulator 118 as well as leak over the orifice 152. After the accumulator 118 is charged, the charging valve 136 remains open to permit pressurized hydraulic fluid to continue to leak over the orifice 152 and return to the reservoir 122. This leakage flow generates heat as the hydraulic fluid transitions from high pressure on the upstream side of the orifice 152 to low pressure on the downstream side of the orifice, and returns the heated fluid to the reservoir 122. This leakage flow also allows hydraulic fluid to circulate between the reservoir 122, the pump 120, and the valve block 116, distributing heated hydraulic fluid throughout these systems. The size of the orifice 152 may be chosen to balance the amount of heating resulting from this leakage flow with other performance considerations of the valve block 116 and the pump 120.

FIG. 5 is a hydraulic schematic illustrating the valve block 116 with the charging valve 136 in the open position and the discharging valve 140 in the open position. In this configuration, the pump 120 provides pressurized hydraulic fluid to the valve block 116 via line 132. With the charging valve 136 and the discharging valve 140 in the open positions, the hydraulic fluid received by the valve block 116 can cross the charging valve 136 and the discharging valve 140, and exit the valve block 116 to the reservoir 122 via the line 130. The pressure drop experienced by this hydraulic fluid as it flows through the hydraulic system 110 from the pump 120 to the reservoir 122 will be converted to heat, warming up the hydraulic fluid as it returns to the reservoir 122. This flow path also allows hydraulic fluid to circulate between the reservoir 122, the pump 120, and the valve block 116, distributing heated hydraulic fluid throughout these systems.

FIGS. 3-5 illustrate how the configuration of the hydraulic system 110 can be utilized to provide a warmup feature to a hydraulic system with a ride control feature without the addition of dedicated warmup valves or orifices. This may allow a warmup feature to be provided at a reduced cost or complexity for certain applications. FIGS. 4-5 also illustrate how the hydraulic system 110 allows for different warmup operations with the same hardware, with FIG. 4 illustrating a warmup operation that allows the accumulator 118 to be charged while heating the hydraulic fluid in the hydraulic system 110 using only a leakage path across an orifice, orifice 152. By contrast, FIG. 5 allows a higher flow leakage path, if the charging valve 136, discharging valve 140, and internal connecting passageways are sized appropriately and the pump 120 has the capacity, permitting the hydraulic system 110 to be heated faster but which does not permit the accumulator 118 to be charged to pressure. Depending on the application or specific needs of the hydraulic system 110 at warmup time, the controller 138 may chose the most appropriate warmup operation.

Figure 6:
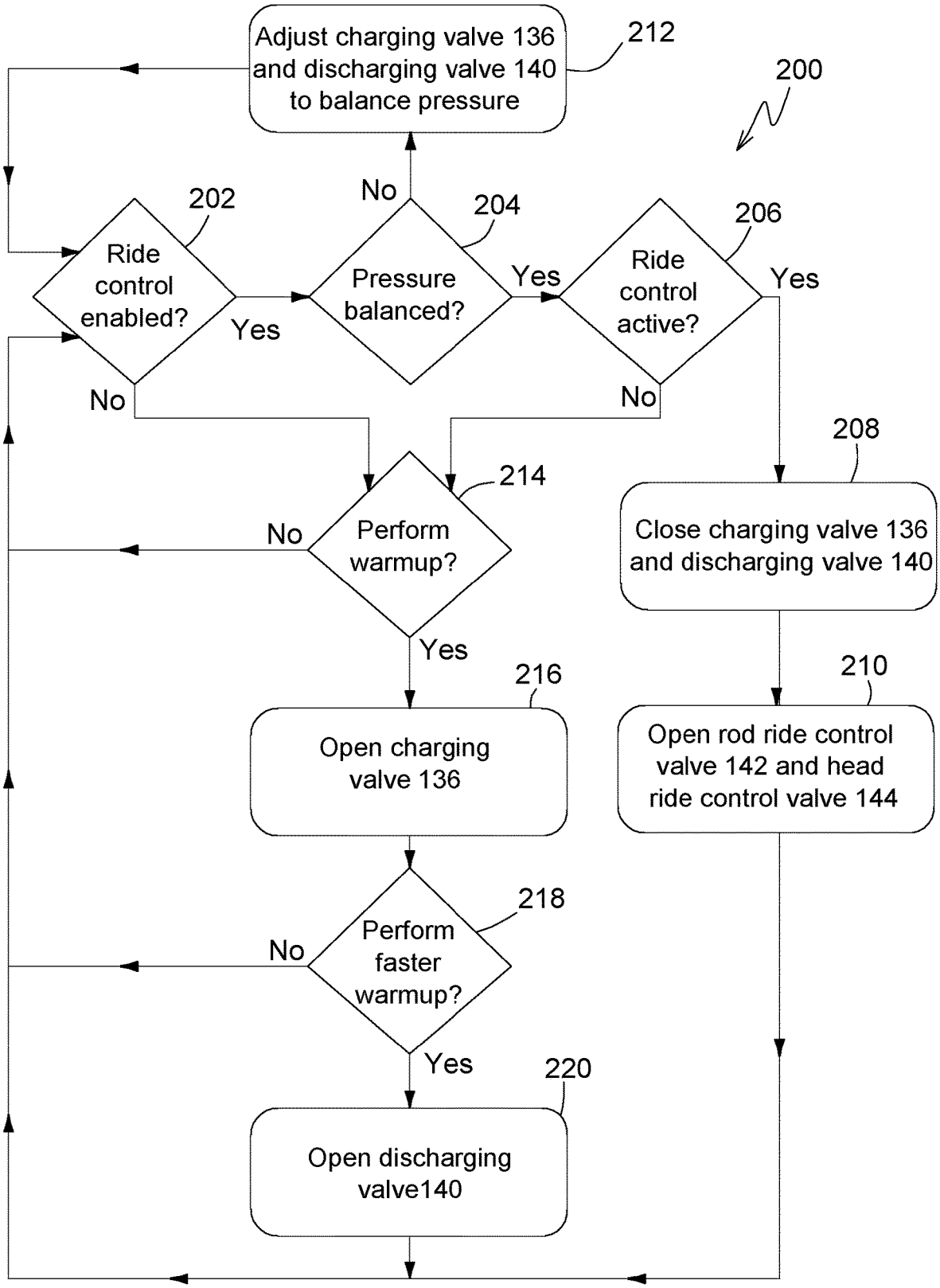
FIG. 6 is a flowchart for a control system for the hydraulic system.

FIG. 6 is a flowchart illustrating a control system 200 being run on the controller 138. The control system 200 controls the ride control and warmup features of the hydraulic system 110. In step 202, the controller 138 determines whether ride control is enabled and proceeds to step 204 if it is, and step 214 if it is not. The controller 138 determines whether ride control is enabled by monitoring whether the operator of the work vehicle 100 has enabled it, for example by actuating a switch in the operator's station, but in alternative embodiments other methods may be used to enable or disable the ride control feature for the work vehicle 100 (e.g., always enabled, remotely enabled, enabled when certain speed and load conditions are satisfied). Additionally, in alternative embodiments the controller 138 may disable ride control in step 202 in order to perform a warmup if the need for a warmup is detected (e.g., based on the temperature of the hydraulic fluid), or it may disable ride control to perform a warmup only in certain circumstances (e.g., if the machine is parked or traveling below a certain speed). Therefore, the controller 138 may determine whether the ride control feature is enabled either passively (by checking whether ride control is already enabled) or actively (by disabling the ride control feature if it is currently enabled).

In step 204, the controller 138 determines whether the pressure is balanced between the accumulator 118 and the boom cylinders 112, specifically the head side of the boom cylinders 112, and proceeds to step 206 if it is and step 212 if it is not. The controller 138 determines whether the pressure is balanced by comparing the signals it receives, directly or indirectly, from the head side sensor 146 (sensing the pressure in the head side of the boom cylinders 112) and the accumulator sensor 150 (sensing the pressure in the accumulator 118). If the signals from those two sensors indicate the same pressure or a pressure within a threshold amount of each other (e.g., 5 bar), then the controller 138 determines that the pressures are balanced.

In step 206, the controller 138 determines whether the ride control feature of the hydraulic system 110 is active and proceeds to step 208 if it is, and step 214 if it is not. The controller 138 may determine whether ride control is active by monitoring whether the work vehicle 100 is traveling over a threshold speed, whether there is a load in the work tool 108, whether the operator has forced ride control into the active state, other factors, or a combination of these. In alternative embodiments, the controller 138 may deactivate ride control in step 206 in order to enable a warmup to occur, for example if the need for a warmup is detected (e.g., based on the temperature of the hydraulic fluid), or it may disable ride control to perform a warmup only in certain circumstances (e.g., if the machine is parked or traveling below a certain speed). Therefore, the controller 138 may determine whether to perform hydraulic fluid warmup in response to determining that the ride control feature has not been activated either passively (by checking that the ride control feature is already inactive) or actively (by deactivating the ride control feature if it is currently active). The control system and algorithm which deactivates the ride control feature so as to enable the warmup to occur, and thus permits the control system 200 to proceed to step 214 from step 206, may be included in the control system 200 or may instead be separate from the control system 200.

In step 208, in response to determining that ride control is active, the controller 138 turns off, or keeps off, current to the solenoid 136*c* of the charging valve 136 and the solenoid 140*c* of the discharging valve 140. With the current to their respective solenoids off, each of the charging valve 136 and the discharging valve 140 will shift to, or stay in, the closed position.

In step 210, the controller 138 turns on, or keeps on, current to the solenoid 142*c* of the rod ride control valve 142 and the solenoid 144*c* of the head ride control valve 144. With the current to their respective solenoids on, each of the rod ride control valve 142 and the head ride control valve 144 will shift to, or stay in, the open position. Actuation of the solenoid 142*c* directly actuates the rod ride control valve 142 to the open position, where it hydraulically connects the rod side of the boom cylinders 112 to the reservoir 122 through the line 130, allowing hydraulic fluid to flow between the two components. Actuation of the solenoid 144*c* shifts the pressure source for the first pilot port of the head ride control valve 144, from being supplied by the head side of the boom cylinders 112 to being supplied by the reservoir 122, thus unbalancing the head ride control valve 144 such that pressure in the head side of the boom cylinders 112 over a threshold pressure will tend to shift the head ride control valve 144 from the closed position to the open position. By actuating solenoid 144*c*, the controller 138 thereby puts head ride control valve 144 into a state where sufficient pressure on the head side of the boom cylinders 112 will shift the head ride control valve 144 to allow hydraulic flow between the head side of the boom cylinders 112 and the accumulator 118. After step 210, the ride control feature of the hydraulic system 110 is active and operating.

In step 212, reached if it was determined in step 204 that the pressure is not balanced between the accumulator 118 and head side of the boom cylinders 112, the controller 138 adjusts the charging valve 136 and the discharging valve 140 to balance this pressure. If the controller 138 senses that the pressure of the head side of the boom cylinders 112 is greater than that of the accumulator 118, for example greater by a threshold amount, then the controller 138 actuates the charging valve 136 to the open position (or keeps it in the open position) and actuates the discharging valve 140 to the closed position (or keeps it in the closed position). Opening the charging valve 136, or keeping it open, permits hydraulic fluid to flow from the pump 120 through the line 132 and into the accumulator 118, which tends to raise the pressure in the accumulator 118 and thereby bring it into balance with the higher pressure of the head side of the boom cylinders 112. Closing the discharging valve 140, or keeping it closed, prevents or restricts hydraulic fluid from flowing out of the accumulator 118 through the line 130 to the reservoir 122, which tends to lower the pressure in the accumulator 118 and thereby prevent it from rising to balance to the pressure of the head side of the boom cylinders 112.

If instead the controller 138 senses that the pressure of the head side of the boom cylinders 112 is less than that of the accumulator 118, for example less by a threshold amount, then the controller 138 actuates the charging valve 136 to the closed position and actuates the discharging valve 140 to the open position. Closing the charging valve 136 prevents hydraulic flow from the pump 120 to the accumulator 118, while opening the discharging valve 140 permits hydraulic flow from the accumulator 118 to the reservoir 122, thereby draining the accumulator 118 and reducing its pressure to bring it into balance with the head side of the boom cylinders 112.

In step 214, reached if it was determined that ride control is not enabled (step 202) or not active (step 206), the controller 138 determines whether to perform warmup of hydraulic fluid and proceeds to step 216 if so, and step 202 if not. The controller 138 may determine this in multiple ways, or using a combination of multiple factors. As one example, the controller 138 may monitor the temperature of the hydraulic fluid at a point in the system using the head side sensor 146, if that sensor is capable of both pressure and temperature sensing, and perform warmup if that temperature is below a target temperature (e.g., 50° F.). As another example, the controller 138 may perform warmup if the work vehicle 100 was just started after a period of inactivity (e.g., 30 minutes). As another example, the controller 138 may perform warmup if the work vehicle 100 was just started and the ambient temperature is below a threshold (e.g., 50° F.). As another example, the controller 138 may perform warmup after weighing multiple factors, such as sensed hydraulic fluid temperature, ambient temperature, and the recent activity level of the work vehicle 100.

In step 216, the controller 138 actuates the charging valve 136 to the open position. This permits hydraulic fluid to flow from the pump 120 through the line 132 to the outlet 136*b* of the charging valve 136. From the outlet 136*b* of the charging valve 136, the pressurized hydraulic fluid leaks over the orifice 152 to reach the line 130 and travel to the reservoir 122. As the pressurized hydraulic fluid leaks over the orifice 152, heat is generated from the resulting pressure drop of the hydraulic fluid, and the heated hydraulic fluid is then returned to the reservoir 122 where its heat can be spread throughout other hydraulic fluid in the work vehicle 100. The equivalent orifice diameter of the orifice 152, or the diameter of a circular orifice of the same flow resistance, may be selected to achieve the amount of heating desired for this warmup feature while also meeting other performance targets for the valve block 116. In the embodiment illustrated in FIG. 3, the orifice 152 has a diameter of 0.030 inches, but in some alternative embodiments of the valve block 116 this may be between a diameter of 0.010 to 0.100 inches which may meet the performance requirements for other components within the valve block 116.

In step 218, the controller 138 determines whether to perform a faster warmup and proceeds to step 220 if so, and step 202 if not. Like with step 214, the controller 138 may make this determination in multiple ways, or using a combination of multiple factors. In step 218 however, the controller 138 may utilize a higher threshold or cutoff in order to determine that a faster warmup is to be performed. As one example, the controller 138 may determine to perform warmup of hydraulic fluid in step 214 if the hydraulic fluid is below a first temperature (e.g., 50° F.), but may determine a faster warmup is to be performed in step 218 if the hydraulic fluid is below a second temperature (e.g., 0° F.), the second temperature being lower than the first temperature. As other examples, the controller 138 may determine a faster warmup is to be performed if the work vehicle 100 is idle, if the operator of the work vehicle 100 commands it such as through a switch or input button, or if the hydraulic functions on the work vehicle 100 are idle. In another example, regardless of the procedure by which the controller 138 enters the faster warmup mode, the controller 138 may exit the faster warmup if it detects usage of the hydraulic functions on the work vehicle 100, including by sensing pressures, flows, or movement of a hydraulically driven element such as an implement.

In step 220, the controller 138 actuates the discharging valve 140 to the open position. In combination with the charging valve 136 being opened or kept open in step 216, this permits hydraulic fluid to flow from the pump 120, through the charging valve 136, through the discharging valve 140, to the reservoir 122. The pressure drop of the hydraulic fluid as it travels this path is converted to heat, and the heated hydraulic fluid is deposited in the reservoir 122 where it may circulate throughout other hydraulic circuits.

In the embodiment illustrated in FIGS. 3-6, the hydraulic system 110 has a two level warming feature, with the first level providing warming due to hydraulic flow over the orifice 152 and the second level providing additional warming due to hydraulic flow over the discharging valve 140 which has less flow restriction and thereby allows greater heat generation assuming sufficient flow capacity from the pump 120. In alternate embodiments, only one of these two flow paths may be provided, or both paths may be provided but they may be activated in different circumstances according to different instructions on the controller 138.

As used herein, "controller" is intended to be used consistent with how the term is used by a person of skill in the art, and refers to a computing component with processing, memory, and communication capabilities, which is utilized to execute instructions (i.e., stored on the memory or received via the communication capabilities) to control or communicate with one or more other components. In certain embodiments, a controller may also be referred to as a control unit, vehicle control unit (VCU), engine control unit (ECU), transmission control unit (TCU), or electrical controller. In certain embodiments, a controller may be configured to receive input signals in various formats (e.g., hydraulic signals, voltage signals, current signals, CAN messages, optical signals, radio signals), and to output command or communication signals in various formats (e.g., hydraulic signals, voltage signals, current signals, CAN messages, optical signals, radio signals).

The controller 138, which may also be referred to as a vehicle control unit (VCU), a control unit, a control module, a computing device, etc., for the embodiment illustrated in FIGS. 3-6, may be in communication with other components on the work vehicle 100, such as hydraulic components (e.g., valve block 116), electrical components (e.g., solenoid 136*c*, accumulator sensor 150), and operator inputs within an operator station of the work vehicle 100. The controller 138 may be electrically connected to these other components by a wiring harness such that messages, commands, and electrical power may be transmitted between the controller 138 and the other components. Although the controller 138 is referenced in the singular, in alternative embodiments the configuration and functionality described herein can be split across multiple controllers using techniques known to a person of ordinary skill in the art.

Although the terms "inlet" and "outlet" are used herein and in certain embodiments may indicate the most common direction of hydraulic flow, in other embodiments or in certain applications hydraulic fluid could flow into or out of either the inlet or outlet of a valve.

Without in any way limiting the scope, interpretation, or application of the claims appearing below, a technical effect of one or more of the example embodiments disclosed herein is to add a hydraulic fluid warmup feature to a hydraulic circuit with a ride control feature without additional components and without impacting the ride control feature. Another technical effect of one or more of the example embodiments disclosed herein is a hydraulic circuit and a controller thereof which includes two hydraulic warmup pathways that can be selectively engaged in certain circumstances.

As used herein, "e.g." is utilized to non-exhaustively list examples, and carries the same meaning as alternative illustrative phrases such as "including," "including, but not limited to," and "including without limitation." As used herein, unless otherwise limited or modified, lists with elements that are separated by conjunctive terms (e.g., "and") and that are also preceded by the phrase "one or more of," "at least one of," "at least," or a like phrase, indicate configurations or arrangements that potentially include individual elements of the list, or any combination thereof. For example, "at least one of A, B, and C" and "one or more of A, B, and C" each indicate the possibility of only A, only B, only C, or any combination of two or more of A, B, and C (A and B; A and C; B and C; or A, B, and C). As used herein, the singular forms "a", "an" and "the" are intended to include the plural forms as well, unless the context clearly indicates otherwise. Further, "comprises," "includes," and like phrases are intended to specify the presence of stated features, steps, operations, elements, and/or components, but do not preclude the presence or addition of one or more other features, steps, operations, elements, components, and/or groups thereof.

While the present disclosure has been illustrated and described in detail in the drawings and foregoing description, such illustration and description is not restrictive in character, it being understood that illustrative embodiment(s) have been shown and described and that all changes and modifications that come within the spirit of the present disclosure are desired to be protected. Alternative embodiments of the present disclosure may not include all of the features described yet still benefit from at least some of the advantages of such features. Those of ordinary skill in the art may devise their own implementations that incorporate one or more of the features of the present disclosure and fall within the spirit and scope of the appended claims.

What is claimed is:

1. A hydraulic system, comprising:

a pump;

a reservoir;

an accumulator;

a hydraulic cylinder;

a ride control valve assembly including:

a charging valve including a charging valve inlet and a charging valve outlet, the charging valve inlet and charging valve outlet hydraulically connected when the charging valve is in an open position and hydraulically disconnected when the charging valve is in a closed position, the charging valve inlet hydraulically connected to the pump so as to receive hydraulic fluid from the pump, the charging valve outlet hydraulically connected to the accumulator;

a discharging valve with a discharging valve inlet and a discharging valve outlet, the discharging valve inlet and discharging valve outlet hydraulically connected when the discharging valve is in an open position and hydraulically disconnected when the discharging valve is in a closed position, the discharging valve inlet hydraulically connected to the charging valve outlet and the accumulator, the discharging valve outlet hydraulically connected to the reservoir so as to provide hydraulic fluid to the reservoir; and a head ride control valve with a head ride control valve inlet and a head ride control valve outlet, the head ride control valve inlet and head ride control valve outlet hydraulically connected when the head ride control valve is in an open position and hydraulically disconnected when the head ride control valve is in a closed position, the head ride control valve inlet hydraulically connected to the hydraulic cylinder, the head ride control valve outlet hydraulically connected to the accumulator; and a controller in communication with the ride control valve assembly, the controller including a processor and a memory including instructions saved thereon, wherein the processor is configured to execute the instructions to:

determine whether a ride control feature has been activated;

move the head ride control valve to the open position in response to determining the ride control feature has been activated;

determine whether to perform hydraulic fluid warmup; and move the charging valve to the open position in response to determining that the ride control feature has not been activated and that hydraulic fluid warmup is to be performed.

2. The hydraulic system of claim 1, wherein the ride control valve assembly further comprises a hydraulic orifice, the charging valve outlet hydraulically connected to the reservoir via the hydraulic orifice, wherein the controller is further configured to keep the discharging valve in the closed position in response to determining that the ride control feature has not been activated and that hydraulic fluid warmup is to be performed.

3. The hydraulic system of claim 1, wherein the controller is further configured to move the discharging valve to the open position in response to determining that the ride control feature has not been activated and that hydraulic fluid warmup is to be performed.

4. The hydraulic system of claim 1, further comprising:

an accumulator pressure sensor, the accumulator pressure sensor configured to measure a pressure of the accumulator, the accumulator pressure sensor in communication with the controller; and a cylinder pressure sensor, the cylinder pressure sensor configured to measure a pressure in a head end of the hydraulic cylinder, the cylinder pressure sensor in communication with the controller;

wherein the controller is further configured to:

determine whether the ride control feature has been enabled;

compare the pressure of the accumulator with the pressure in the head end of the hydraulic cylinder;

move the charging valve to the open position in response to determining that the ride control feature has been enabled and in response to the sensed pressure in the accumulator being less than the sensed pressure in the hydraulic cylinder; and move the discharging valve to the open position in response to determining that the ride control feature has been enabled and in response to the sensed pressure in the accumulator being greater than the sensed pressure in the hydraulic cylinder.

5. The hydraulic system of claim 4, wherein the ride control valve assembly further comprises a hydraulic orifice, the charging valve outlet hydraulically connected to the reservoir via the hydraulic orifice, wherein the controller is further configured to move the charging valve to the open position and keep the discharging valve in the closed position in response to determining that hydraulic fluid warmup is to be performed.

6. The hydraulic system of claim 4, wherein the controller is further configured to move the charging valve to the open position and move the discharging valve to the open position in response to determining that hydraulic fluid warmup is to be performed.

7. The hydraulic system of claim 4, wherein the controller is further configured to move at least one of the charging valve and discharging valve to the closed position in response to determining that the ride control feature has been activated.

8. The hydraulic system of claim 1, further comprising:

an accumulator pressure sensor, the accumulator pressure sensor configured to measure a pressure of the accumulator, the accumulator pressure sensor in communication with the controller; and a cylinder pressure sensor, the cylinder pressure sensor configured to measure a pressure in a head end of the hydraulic cylinder, the cylinder pressure sensor in communication with the controller;

wherein the controller is further configured to:

determine whether the ride control feature has been enabled;

compare the pressure of the accumulator with the pressure in the head end of the hydraulic cylinder;

move the charging valve to the open position in response to determining the ride control feature has been enabled and in response to the comparison.

9. The hydraulic system of claim 8, wherein the controller is further configured to move the charging valve to the open position in response to determining the ride control feature has been enabled and in response to determining the pressure of the accumulator is more than a threshold below the pressure in the head end of the hydraulic cylinder.

10. The hydraulic system of claim 1, wherein the controller is further configured to determine whether to perform hydraulic fluid warmup based on a temperature of the hydraulic fluid.

11. The hydraulic system of claim 1, wherein the pump is a load-sensing pump.

12. The hydraulic system of claim 2, wherein the hydraulic orifice has an equivalent orifice diameter of 0.010 inches to 0.100 inches.

13. A method of operating a hydraulic system, the method comprising:

determining whether a ride control feature has been activated;

moving a ride control valve to an open position to enable hydraulic fluid to flow from a hydraulic cylinder through the ride control valve to an accumulator in response to determining that the ride control feature has been activated;

determining whether to perform hydraulic fluid warmup in response to determining that the ride control feature has not been activated;

performing hydraulic fluid warmup by moving at least one of a charging valve and a discharging valve to an open position in response to determining that hydraulic fluid warmup is to be performed, a charging valve inlet hydraulically connected to a pump so as to receive hydraulic fluid from the pump, a charging valve outlet hydraulically connected to the accumulator, the charging valve inlet and charging valve outlet hydraulically connected when the charging valve is in the open position and hydraulically disconnected when the charging valve is in a closed position, a discharging valve inlet hydraulically connected to the accumulator, a discharging valve outlet hydraulically connected to a reservoir so as to provide hydraulic fluid to the reservoir, the discharging valve inlet and discharging valve outlet hydraulically connected when the discharging valve is in the open position and hydraulically disconnected when the discharging valve is in a closed position.

14. The method of claim 13, wherein the charging valve outlet is hydraulically connected to the reservoir via a hydraulic orifice, and performing hydraulic fluid warmup comprises moving the charging valve to the open position and keeping the discharging valve in the closed position.

15. The method of claim 13, wherein performing hydraulic fluid warmup comprises moving the charging valve to the open position and moving the discharging valve to the open position.

16. The method of claim 13, further comprising:

determining whether the ride control feature has been enabled; and moving the charging valve to the open position in response to determining that the ride control feature has been enabled.

17. The method of claim 16, wherein the charging valve outlet is connected to the reservoir via a hydraulic orifice, and performing hydraulic fluid warmup comprises moving the charging valve to the open position and keeping the discharging valve in the closed position.

18. The method of claim 16, wherein performing hydraulic fluid warmup comprises moving the charging valve to the open position and moving the discharging valve to the open position.

19. The method of claim 13, further comprising:

determining whether the ride control feature has been enabled;

comparing a pressure of the accumulator with a pressure in a head end of the hydraulic cylinder;

moving the charging valve to the open position in response to determining that the ride control feature has been enabled and in response to the pressure comparison.

20. The method of claim 13, further comprising determining whether to perform hydraulic fluid warmup based on a temperature of the hydraulic fluid.

* * * * *